US006084350A

United States Patent [19]

Ezaki et al.

[11] Patent Number: 6,084,350

[45] Date of Patent: Jul. 4, 2000

[54] ION GENERATING DEVICE

[75] Inventors: Shiro Ezaki; Tsukasa Sugano, both of Yokohama, Japan

[73] Assignee: Toshiba Lighting & Technology Corp., Tokyo, Japan

[21] Appl. No.: 09/031,724

[22] Filed: Feb. 27, 1998

[30] Foreign Application Priority Data

| | | | |
|---|---|---|---|
| Feb. 28, 1997 | [JP] | Japan | 9-046566 |
| Apr. 23, 1997 | [JP] | Japan | 9-106353 |
| Dec. 26, 1997 | [JP] | Japan | 9-360824 |

[51] Int. Cl.[7] ..... H01J 17/4

[52] U.S. Cl. ..... 313/587; 313/586; 313/231.41

[58] Field of Search ..... 313/231.41, 586, 313/587, 483, 355, 360.1; 315/111.81, 111.21; 250/426; 347/123; 361/230

[56] References Cited

U.S. PATENT DOCUMENTS

| | | | |
|---|---|---|---|
| 3,935,494 | 1/1976 | Dick et al. | 313/587 |
| 4,985,716 | 1/1991 | Hosaka et al. . | |

FOREIGN PATENT DOCUMENTS

| | | |
|---|---|---|
| 6-75457 | 3/1994 | Japan . |
| 8-82980 | 3/1996 | Japan . |

*Primary Examiner*—Nimeshkumar D. Patel
*Assistant Examiner*—Todd Reed Hopper
*Attorney, Agent, or Firm*—Pillsbury Madison & Sutro LLP

[57] ABSTRACT

An ion generating device according to the present invention has a substrate having at least one insulating surface. A pair of electrodes is separately formed on the substrate to generate a corona discharge therebetween for ionizing gas floating in the atmosphere around the device. A protective layer having a thickness between 0.5 $\mu$m and 10 $\mu$m is limitedly coated on an exposed surface of the electrode.

22 Claims, 5 Drawing Sheets

ION GENERATING DEVICE

BACKGROUND OF THE INVENTION

1. Field of the Invention

The present invention relates to an ion generating device.

2. Description of the Related Art

A conventional ion generating device generates ions used as a source of corona ions for forming electrostatic latent images in an electrophotography recording machine such as a laser beam printer, copy machine and so on.

Japanese Laid Open Patent Application No. 8-82980 discloses an ion generator having a pair of electrodes formed on a ceramic substrate for generating corona discharge. FIG. 9 is a schematic drawing showing this ion generating device adapted for an electrophotography recording machine.

The electrodes of the ion generating device include a first electrode 102 and a second electrode 104. The first electrode 102 is formed on the substrate 101 by a forming method of a conventional thin film. A dielectric layer 103 coats the first electrode 102, and the surface of the substrate 101 insulates between the electrodes. The second electrode 104 is on the dielectric layer 103, but the second electrode 104 is not located directly above the first electrode 102. A protective layer 108 coats the whole surfaces of the dielectric layer 103 and the second electrode 104 for protection.

As shown in FIG. 9, a conductive drum which functions as a photosensitive medium 105 is near the ion generating device so that the gap formed between the medium and the ion generating device has a predetermined width. The photosensitive medium 105 is positively charged by a DC power source 107.

When a high frequency power source 106 applies high frequency voltage between the first electrode 102 and the second electrode 104, an alternating leakage electric field E having a periodically alternating polarity is generated between the first electrode 102 and the second electrode 104 as indicated by arrows in FIG. 9. The leakage electric field E which penetrates through the atmosphere ionizes gas existing around the surface of the device, such as water vapor and methane gas, and negative and positive ions are generated. The amount of ion generation is proportional to the intensity of the leakage electric field E which penetrates through the atmosphere.

Negative ions generated near the device selectively flow toward the photosensitive medium 105 supplied with a positive bias. Accordingly, the photosensitive medium 105 is uniformly charged with positive potential.

The charged potential on the photosensitive medium 105 can be altered by adjusting the bias voltage applied between the second electrode 104 and the photosensitive medium 105.

However, the ion generating device, which has a protective layer 108 coating the whole surface, has the following problems. A part of the protective layer 108 functions as a protector against collisions with ions. The other parts of the layer 108 which is appears as a stray capacitance formed between the electrodes, are not necessary to protect the electrode. In the ion generating device, the leakage electric field E is weakened by the other parts of the protective layer 108, because the leakage electric field E passes through the other parts of the layer while the field penetrates the atmosphere.

Furthermore, a thicker protective layer is preferable to protect the electrode. However, the thicker protective layer increases the stray capacitance around the electrode. Since the stray capacitance reduces the intensity of leakage electric field, the amount of ions generated by the device decreases. When a high voltage is applied to the device, the thicker protective layer loses effectiveness because the ion collisions will be strengthened. Accordingly, it is difficult to protect the electrode while obtaining sufficient ions.

SUMMARY OF THE INVENTION

Accordingly, a primary object of the present invention is to provide an ion generating device that enables sufficient ion generation without reducing the mechanical intensity of the protective layer.

An ion generating device according to the present invention has a substrate having at least one insulating surface. A pair of electrodes are separately formed on the substrate to generate a corona discharge therebetween for ionizing the atmosphere. A protective layer having a thickness, for example, between 0.5 $\mu$m and 10 $\mu$m is limitedly coated on an exposed surface of the electrode.

These and other aspects of the invention are further described in the following drawings and detailed description of the invention.

BRIEF DESCRIPTION OF THE DRAWINGS

The invention will be described in more detail below in conjunction with the following drawings of which.

DETAILED DESCRIPTION

A first embodiment of this invention will be explained with reference to FIGS. 1 to 3.

Figure 1:
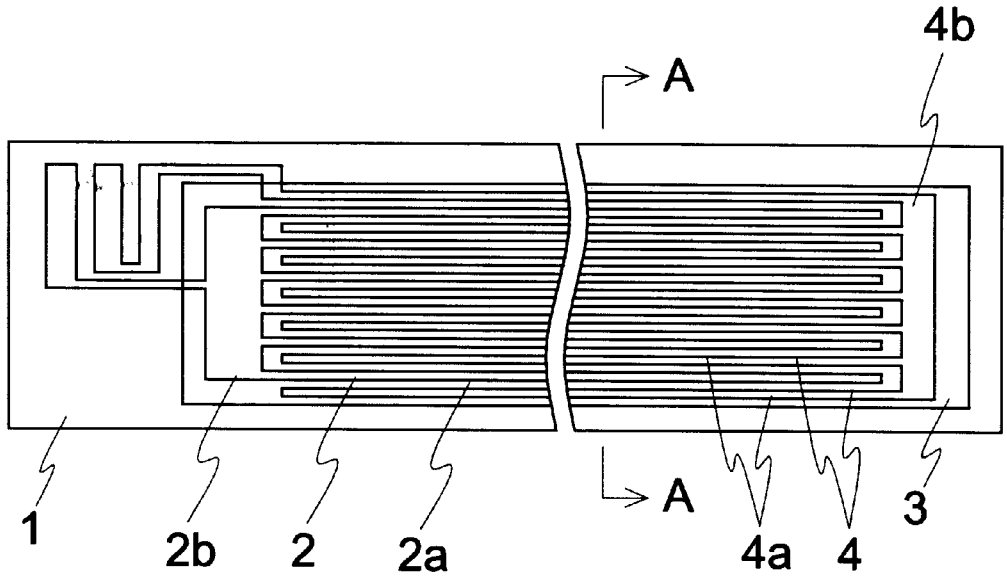
FIG. 1 is a schematic plane front view of a ion generating device according to a first embodiment of the present invention.

FIG. 1 shows a schematic plane view of an ion generating device. The ion generating device includes a substrate 1, first electrode 2, a dielectric layer 3, second electrode 4, and a protective layer 5. Substrate 1 is a rectangular alumina ceramics plate having a length of about 360 mm, a width of about 8 mm, and a thickness of about 0.65 mm. The first and second electrodes 2, 4 have comb teeth shaped discharge portions 2*a*, 4*a* and a terminal portion 2*b*, 4*b* to electrically connect the discharge portions 2*a*, 4*a*, respectively. In this embodiment, the first electrode 2 has six discharge portions 2*a* each having a width of about 100 $\mu$m and a thickness of 5 $\mu$m. The second electrode 4 has seven discharge portions 4*a* each having a width of about 200 $\mu$m and a thickness of 5 $\mu$m. The dielectric layer 3 coats surfaces of the first electrode 2 and the substrate 1.

The second electrode 4 is so provided on the dielectric layer 3 that the discharge portions 4*a* of second electrode 4 are not located above each discharge portion 2*a* of first electrode 2. Each horizontal distance spaced between the edges of those discharge portions 2*a*, 4*a* is about 450 μm. Each electrode 2, 4 is formed by a forming method of a conventional thick film as mentioned below. Conductive paste, for example, such as metal alloy containing silver and platinum as principal ingredients, is screen printed on the surface of substrate 1. The conductive paste is fired to form the first electrode 2. After the first electrode 2 is formed on the substrate 1, dielectrical paste, for example, such as non conductive material containing borosilicate flint glass as principal ingredients, is screen printed on the surfaces 1 of the first electrode 2 and substrate 1. Then the dielectrical paste is fired to form the dielectric layer 3. Next, the conductive paste mentioned above is screen printed on the dielectric layer 3, then the paste is fired to form the second electrode 4.

A protective layer 5 having an efficient thickness, such as about 10 μm or less, limitedly coats the exposed surface of second electrode 4 for preventing sputter of the second electrode 4. The thickness of protective layer 5 is preferably selected from 0.5 μm to 10 μm. If the thickness of protective layer 5 is more than 10 μm, the solidity of the layer 5 tends to reduce because many pin-holes are formed during the firing step of the layer 5. Accordingly, the protective layer 5 having thickness more than 10 μm is easily scraped by the collision with the ions.

Oppositely, if the thickness of the protective layer 5 is less than 0.5 μm, mechanical intensity of the layer becomes weak in proportional to the thickness.

The protective layer may be formed by screen printing and may be formed of the same materials as the dielectric layer 3.

Figure 2:
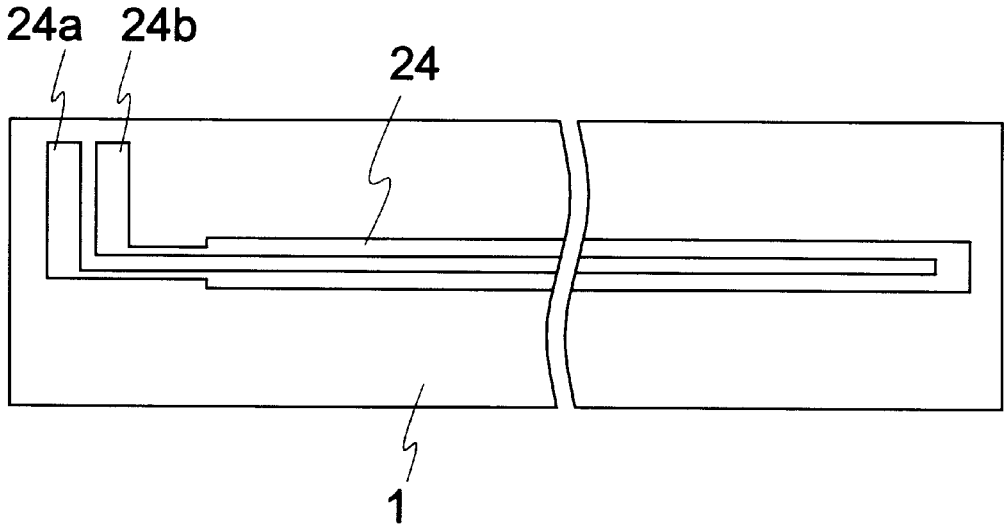
FIG. 2 is a schematic back view of the device shown in FIG. 1.
Figure 3:
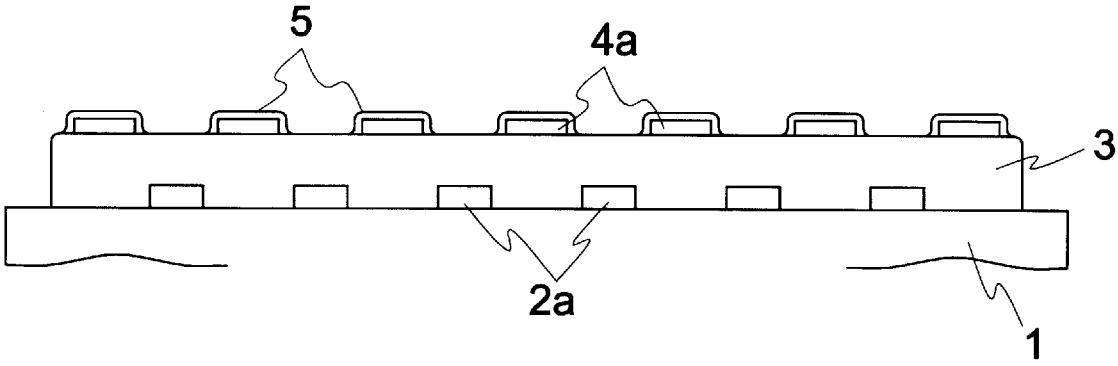
FIG. 3 is a cross-sectional view taken along the lines A—A of FIG. 1.

As shown in FIG. 2, a heater 24 which heats the discharge portions of first and second electrodes 2, 4 may be formed on an opposite surface of the substrate 1 in order to evaporate materials deposited on the surface of protective layer 5. If materials, such as water vapor, deposit on the surface, the leakage electric field E is weakened due to the capacitance of those materials. In this embodiment, the heater 24 which is made from silver-platinum alloy has U-shape. Terminals 24*a*, 24*b* are over-lapped on the both ends of the heater 24 to supply an electric heat power.

When an alternative high voltage, such as 2.5 KV of 5 KHz, is provided to the electrodes 2, 4 of the ion generating device, an alternating leakage electric field E having a periodically alternating polarity is generated between the first electrode 2 and the second electrode 4. The leakage electric field E which penetrates through the atmosphere ionizes gas floating in the atmosphere around the device, such as water vapor and methane gas; then negative and positive ions are generated. Negative ions generated near the device selectively flow toward the photosensitive medium supplied with a positive bias. Accordingly, the photosensitive medium is uniformly charged with positive potential.

According to this embodiment, the stray capacitance does not increase because the protective layer 5 is limitedly coated on an exposed surfaces of each discharge portions 2*a*, 4*a*. Therefore, the device of the present embodiment efficiently ionizes gas in the atmosphere. Furthermore, the protective layer 5 can efficiently protect the second electrode 4 provided under the protective layer 5 as the layer 5 has a thickness of about 10 μm.

Other embodiments in accordance with the present invention are shown in FIGS. 4–8 and explained next. Like reference characters designate identical or corresponding elements of the above disclosed first embodiment. The construction and operation of the following embodiments are substantially the same as the first embodiment and, therefore, detailed explanations of the operation is not provided.

Figure 4:
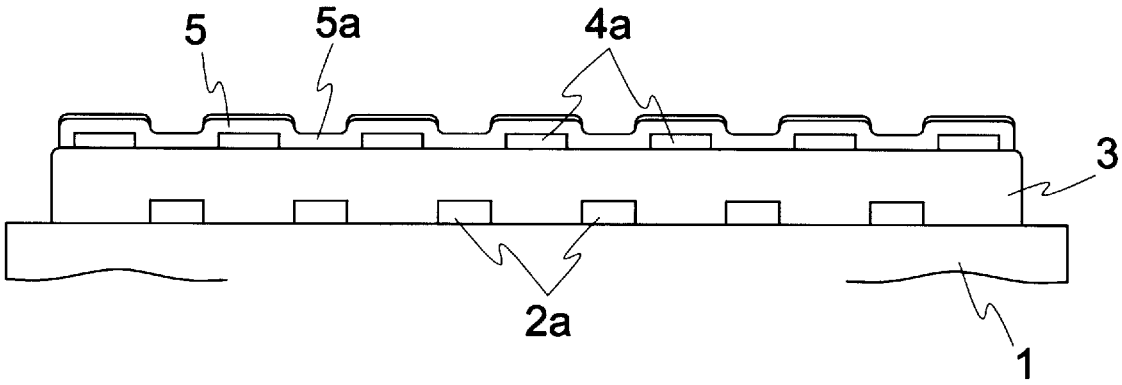
FIG. 4 is a cross-sectional view of a device according to a second embodiment of the present invention.

A second embodiment of this invention will be explained with reference to FIG. 4. FIG. 4 shows a cross-sectional view of a device according to the second embodiment of the present invention. The ion generating device has a second protective layer 5*a* continuously provided around the protective layer 5 coated on the discharge portions 4*a* of the second electrode 4. The thickness of the discharge portions 4*a* of the second electrode 4 and the second protective layer 5*a* are 6 μm and 5 μm, respectively. The second protective layer 5*a* is also formed by conventional manufacturing steps mentioned above. In this embodiment, the second protective layer 5*a* is simultaneously formed when the protective layer 5 coated on the surface of the second electrode 4 is formed. The partial thickness of the protective layer 5 at each side of the discharge portions 4*a* becomes thin when the layer 5 is formed by screen printing because the printing paste tends to drop toward the lower level. However, according to the present embodiment, the discharge portions 4*a* of the second electrode 4 are efficiently coated by the protective layer 5 since the second protective layer 5*a* partially coats the side of the discharge portion 4*a* and dams up the dropping paste. Furthermore, although the stray capacitance between the discharge portions 2*a*, 4*a* increases as the thickness of the second protective layer 5*a* increases, the stray capacitance based on the second protective layer 5*a* can be maintained lower because the second protective layer 5*a* has a relatively thin thickness.

Figure 5:
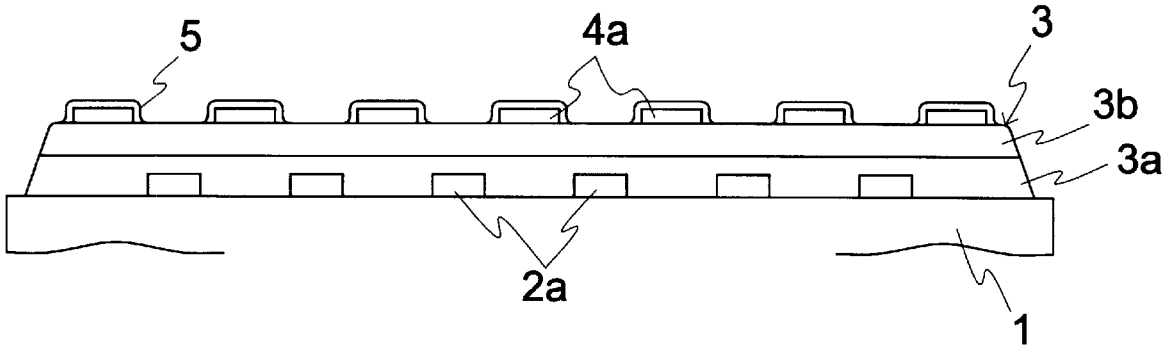
FIG. 5 is a cross-sectional view of a device according to a third embodiment of the present invention.
Figure 6:
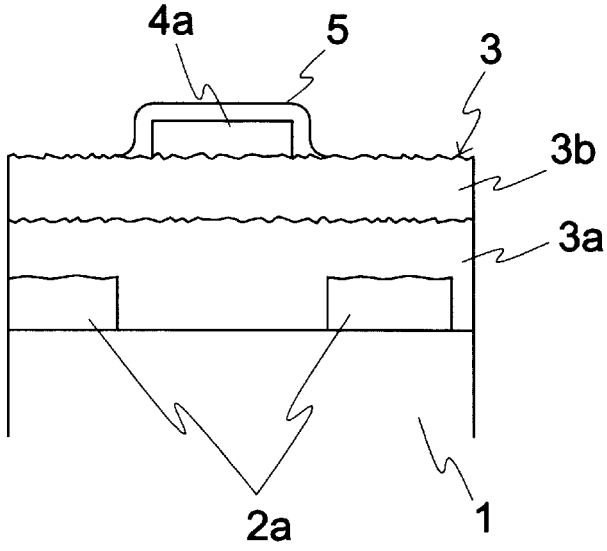
FIG. 6 is an enlarged cross-sectional view of the device shown in FIG. 5.

A third embodiment of the present invention will be explained with reference to FIG. 5 and FIG. 6. In the present embodiment, a dielectric layer 3 is comprised of an under layer 3*a* and an upper layer 3*b*. The upper layer 3*b* coats the whole surface of the under layer 3*a* which coats the substrate 1 and the discharge portions 2*a* of the first electrode 2. The under and upper layers 3*a*, 3*b* are formed by firing a paste containing a borosilicate flint glass and alumina ceramics fillers. The amounts of the fillers contained in the under and upper layers 3*a*, 3*b* are preferably selected so that the upper layer 3*b* relatively contains fewer fillers. Although the fillers strengthen the mechanical intensity of a layer containing the filler, the filler deteriorates the surface smoothness of the layer. Accordingly, the under layer 3*a* consists of borosilicate glass containing 30 Wt % alumina ceramics filler in order to obtain good insulating property. Oppositely, the upper layer 3*b* consists of borosilicate glass containing 10 Wt % alumina ceramics fillers as to provide a smoothing surface.

Furthermore, a softening temperature of the borosilicate flint glass for forming the upper layer 3*b* is preferably lower than that of the borosilicate flint glass for forming the under layer 3*a*. In this embodiment, each glass for forming the under and the upper layers 3*a*, 3*b* has the softening temperature of 570° C. and 510° C., respectively. The layer containing glass having a low softening temperature has the advantage that the surface of the layer likely has good smoothness, because glass having low softening temperature has low viscosity. The softening temperature of glass is controlled by adjusting the mixing ratio of borosilicate.

The second electrode 4 having a thickness of 2 μm is formed by firing a paste containing an organometallic metal compound. The protective layer 5 having a thickness of about 5 μm limitedly coats the surface of the discharge portions 4*a* of the second electrode 4.

According to the present embodiment, a higher voltage can be applied between first and second electrodes so that the amount of ion generation increases. Furthermore, the second electrode 4 coated on the upper layer 3*b* tends to have a uniform thickness since the upper layer 3*b* of the dielectric layer 3 has a good smoothing surface. Therefore, it is easy to form the protective layer 5 coating the second electrode 4, uniformly.

Figure 7:
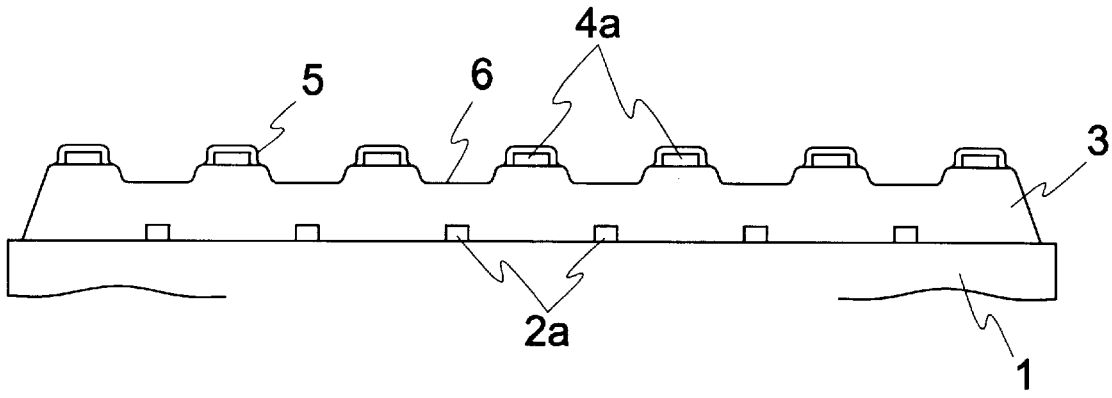
FIG. 7 is a cross-sectional view of a device according to a fourth embodiment of the present invention.

A fourth embodiment of the present invention will be explained with reference to FIG. 7. In the present embodiment, the dielectric layer 3 has recesses 6 provided between each discharge portion 4*a* of the second electrode 4. Each recess 6 has a predetermined depth, for example 10 μm, in order to strengthen the leakage electric field which penetrates through the atmosphere around the discharge portions 4*a*.

Figure 8:
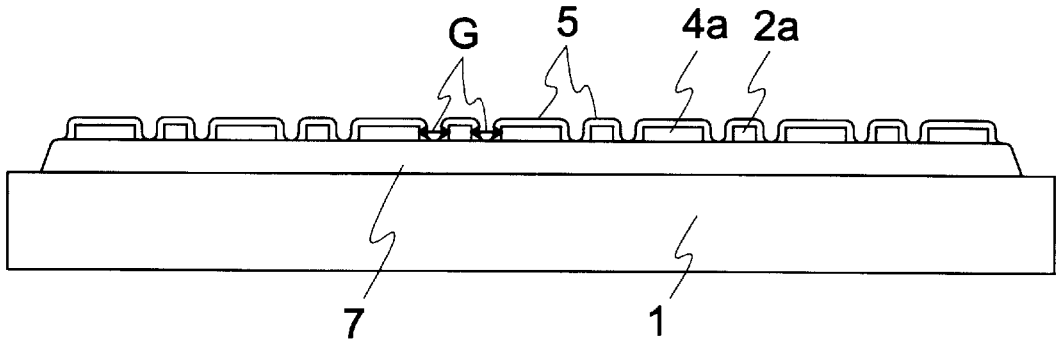
FIG. 8 is a cross-sectional view of a device according to a fifth embodiment of the present invention.
Figure 9:
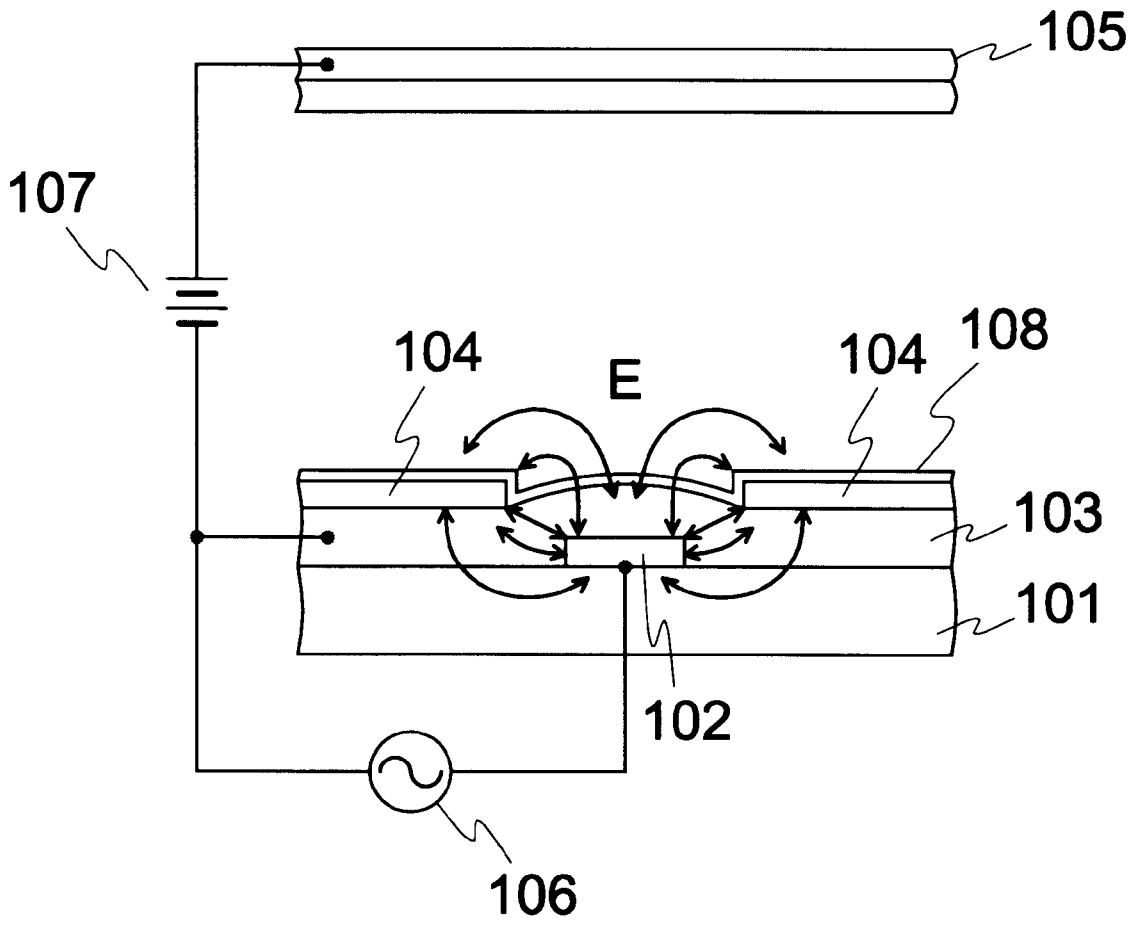
FIG. 9 is a schematic block diagram of a conventional apparatus for generating ions.

A fifth embodiment of the present invention will be explained with reference to FIG. 8. The surface of substrate 1 is coated by an insulating layer 7 having a thickness of 20 μm in the present embodiment. Each discharge portions 2*a*, 4*a* of the first and second electrodes 2, 4 are alternately juxtaposed on the insulating layer 7 so that each distance G spaced between each adjacent discharge portions 2*a*, 4*a* is about 500 μm. The protective layer 5 limitedly coats each discharge portions 2*a*, 4*a* of the first and second electrodes. A second protective layer, which is thinner than the protective layer 5, may be continuously provided around the protective layer 5 for obtaining a uniform thickness of the protective layer 5.

According to the present embodiment, a leakage electric field is generated between each adjacent discharge portions 2*a*, 4*a* when a high voltage is applied between the electrodes 2, 4. The leakage electric field penetrates through the atmosphere, then the field ionizes gas floated in the atmosphere around the device.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. An ion generating device comprising:

an insulating layer;

a pair of electrodes each in contact with the insulating layer to generate a corona discharge therebetween for ionizing the atmosphere; and a protective layer having a thickness between 0.5 μm and 10 μm limitedly coated on an exposed surface of at least one of the electrodes.

2. The ion generating device according to claim 1, wherein the insulating layer is intermediately disposed between said electrodes, said one electrode is provided under the insulating layer and the other electrode is provided on the insulating layer.

3. The ion generating device according to claim 2, wherein each electrode has plural discharge portions and a connecting portion which electrically connects said discharge portions.

4. The ion generating device according to claim 3, wherein the device is manufactured by utilizing a screen printing process for forming thick films.

5. The ion generating device according to claim 3, wherein the insulating layer has recesses located along each discharge portion of one electrode, and the other discharge portions of the other electrode are provided along said each recess.

6. The ion generating device according to claim 3, wherein the insulating layer comprises upper and under layers.

7. The ion generating device according to claim 6, wherein the upper layer relatively contains fillers having a higher fusing temperature than that of said under layer.

8. The ion generating device according to claim 1, wherein the pair of electrodes are on the same level.

9. The ion generating device according to claim 8, wherein each electrode has plural discharge portions and a connecting portion which electrically connects said discharge portions.

10. The ion generating device according to claim 9, wherein the device is manufactured by utilizing a screen printing process for forming thick films.

11. The ion generating device according to claim 1, further comprising a second protective layer continuously disposed around the protective layer limitedly coated on an exposed surface of the electrode, said second protective layer having a thinner thickness than the protective layer.

12. The ion generating device according to claim 11, wherein said insulating layer is intermediately disposed between said electrodes.

13. The ion generating device according to claim 12, wherein each electrode has plural discharge portions and a connecting portion which electrically connects said discharge portions.

14. The ion generating device according to claim 13, wherein the device is manufactured by utilizing a screen printing process for forming thick films.

15. The ion generating device according to claim 14, wherein the insulating layer has recesses located along each discharge portion of one electrode, and the other discharge portions of the other electrode are provided along said each recess.

16. The ion generating device according to claim 13, wherein the insulating layer comprises upper and under layers.

17. The ion generating device according to claim 16, wherein the upper layer relatively contains fillers having a higher fusing temperature than said under layer.

18. The ion generating device according to claim 11, wherein the pair of electrodes are on the same level.

19. The ion generating device according to claim 18, wherein each electrode has plural discharge portions and a connecting portion which electrically connects said discharge portions.

20. The ion generating device according to claim 19, wherein the device is manufactured by utilizing a screen printing process for forming thick films.

21. An ion generating device that generates an electric field in an atmosphere, comprising:

a substrate;

a first electrode on the substrate;

an insulation layer covering the first electrode and the substrate;

a second electrode on the insulation layer, the second electrode being displaced from the first electrode; and a protective layer covering only the second electrode.

22. An ion generating device that generates an electric field in an atmosphere, comprising:

a substrate;

a first electrode on the substrate;

an insulation layer covering the first electrode and the substrate;

a second electrode on the insulation layer, the second electrode being displaced from the first electrode; and a protective layer covering the second electrode and the insulation layer, the thickness of the protective layer being greater over the second electrode than over the insulation layer.

* * * * *